US005949083A

United States Patent [19]

Brachet et al.

[11] Patent Number: 5,949,083

[45] Date of Patent: Sep. 7, 1999

[54] CONTAINER COMPRISING A FORGED STEEL BODY OF NON-CIRCULAR CROSS-SECTION FOR NUCLEAR FUEL ASSEMBLIES

[75] Inventors: Yves Brachet, Meudon; Bernard Kirchner, Gif-sur-Yvette, both of France

[73] Assignee: Transnucleaire, Paris, France

[21] Appl. No.: 09/105,791

[22] Filed: Jun. 26, 1998

Related U.S. Application Data

[62] Division of application No. 08/704,750, Mar. 18, 1997, Pat. No. 5,844,245.

[51] Int. Cl.[6] ..... G21F 5/002

[52] U.S. Cl. ..... 250/506.1

[58] Field of Search ..... 250/506.1, 515.1; 376/272; 220/604, 606; 164/54

[56] References Cited

U.S. PATENT DOCUMENTS 5,844,245 12/1998 Brachet et al. ..... 250/506.1

*Primary Examiner*—Kiet T. Nguyen

*Attorney, Agent, or Firm*—Dennison, Meserole, Scheiner & Schultz

[57] ABSTRACT

A container for nuclear fuel assemblies comprises a thick cylindrical body of forged steel which delimits an inner cavity for housing said assemblies, said cavity being able to be hermetically sealed at its two ends by plugs which are also formed of metal, characterized in that the cross section of the cylindrical body is non-circular. The outer wall usually comprising flat surfaces which are parallel to the flat face of crescent-shaped sections fixed to its inner wall, providing the cross section with the shape of a square or rectangle with rounded corners.

6 Claims, 2 Drawing Sheets

CONTAINER COMPRISING A FORGED STEEL BODY OF NON-CIRCULAR CROSS-SECTION FOR NUCLEAR FUEL ASSEMBLIES

This application is a division of 08/704,750 filed Mar. 18, 1997, now U.S. Pat. No. 5,844,245.

FIELD OF THE INVENTION

The invention concerns a container for transporting or storing nuclear fuel assemblies said container comprising a forged metal body, usually of forged steel, which delimits a cavity into which the assemblies are placed. The invention also concerns its method of manufacture.

DESCRIPTION OF THE RELATED ART

Nuclear fuel assemblies are generally prismatic or cylindrical, usually with a square cross-section (for example, PWR, BWR, . . . ), occasionally with a hexagonal cross-section (VVER, . . .). and occasionally with a circular section (CANDU, RBMK, . . . ).

One problem with which the designer of the container is faced is that of being able to house the maximum number of assemblies in the container cavity while complying with current regulations; in particular, the container must have:

- shielding which is sufficient against the radiation emitted by the radioactive material contents;
- mechanical strength and a seal which are sufficient to ensure containment of the radioactive material contents, even in the event of an accident;
- sufficient thermal conductivity to conduct the heat which may be released by the radioactive assemblies housed in the cavity towards the body of the container, in order to limit the temperature reached.

In addition, the weight of the container and its overall dimensions must be limited so as to be compatible with the equipment in the operational installations (reactors, intermediate storage installations, reprocessing plants, transportation means).

A container with a cavity whose cross-sectional shape is adapted to that of the fuel assemblies and whose body shape is such that side by side storage of a plurality of containers takes up a minimum of space, is of particular advantage.

From this viewpoint, it is not entirely satisfactory to use a container having, for example, a cavity with a circular cross-section to house fuel assemblies of square cross-section. Similarly, containers whose outer body surface is of circular cross-section are not always satisfactory.

Metal containers can be constructed using a number of technologies: cast iron containers (casting), multi-layered steel/steel containers (rolled-welded), lead containers (lead cast between two rolled-welded steel enclosures), forged steel containers (shell forged and then lathe turned).

These technologies which are based on procedures involving rotation about an axis (rolling of sheet metal, forging of shells, lathe turning, etc. . . ) are not suitable for putting the above idea of compact storage into practice.

Technologies based on processes such as casting can in principle produce containers with non-circular cross-sections but for reasons connected with the constitution of cast material it is often preferable to use circular containers which allow better control over cooling conditions.

For example, British patent GB 2 003 783 describes a cast iron or steel container for transporting and storing radioactive waste having a non-circular cross-section.

It will also be noted that French patent FR 2 563 652 describes a shell comprising two steel walls with a maximum thickness of 4 mm, between which a thin neutron-absorbing screen is disposed; the square shape of the shell is produced by plastic deformation of the steel walls.

We have thus sought to develop containers with improved weight and overall dimensions relative to the number of fuel assemblies it contains, while observing shielding, thermal conductivity and mechanical strength requirements.

SUMMARY OF THE INVENTION

The invention concerns a container for nuclear fuel assemblies, comprising a thick cylindrical body of forged steel which delimits a cavity for housing said nuclear fuel assemblies, said cavity being able to be hermetically sealed at its two ends by plugs which are also formed of metal, characterized in that the cross-section of the cylindrical body is non-circular.

The container according to the invention thus has a cylindrical metal body with a non-circular cross section. In other words, the cross-section has the appearance of a ring whose inner and outer perimeters are not circular but generally contain straight segments; the perimeters can, for example, be in the shape of squares or other regular concentric polygons whose corners can be rounded.

It is formed by taking a thick metal shell with a circular cross section which delimits an inner cavity in which the assemblies are housed, and forming one or more flat surfaces on the outer and/or inner wall of the shell, the flat surfaces usually being symmetrically disposed on the outer and inner perimeters, and facing one another. For this reason these flat surfaces are formed by grinding so as to extend over the entire height of the outer wall, and/or at least one crescent-shaped section is inserted into the cavity which matches the shape of the inner wall and is fixed thereto. These crescent-shaped sections have a cross-section which comprises an arc of a circle with the same diameter as the inner wall of the cavity and a chord which subtends the arc of the circle and which thus corresponds to a flat portion of the inner wall of the cavity.

There can be 2, 4 or 6 flat surfaces; the outer or inner perimeter of the ring has a square or rectangular shape when there are 4 flat surfaces, or a hexagonal shape when there are 6 flat surfaces.

The thickness of the cylindrical metal body with a non-circular cross-section according to the invention completely satisfies shielding standards. It is usually several tens of centimeters thick.

It can be seen that the shape of the inner cavity can be adapted to the type of fuel assemblies which it is to house. Thus, when the assemblies have a square cross-section, for example, a cavity is preferably selected which has a square or rectangular cross-section, usually with rounded corners; this makes it possible to increase its filling coefficient (less lost space than in a cavity with a circular cross-section).

By forming flat surfaces on the outer wall of the cylindrical body, which flat surfaces usually face the flat portions of the inner wall, the weight and overall dimensions of the container are simultaneously reduced while adequate shielding and mechanical strength is maintained; due to their outer shape the storage density per $m^2$ of the containers is increased.

The cavity inside the cylindrical metal body is usually sealed at its two ends, one which is sealed by a fixed base, attached, for example, by welding with or without hooping, the other by means of a removable cover.

The initial shell with a circular cross-section which must be modified to produce the cylindrical body according to the invention is generally forged steel-based.

Consequently, the cylindrical body of the container according to the invention is of the same composition.

Thus, the outer and inner walls of the forged steel shell are lathe turned coaxially, initially to produce a cylindrical body of circular cross section, then the outer wall is ground to obtain at least one flat surface extending over the entire height of the shell, and preferably 2, 4 or 6 parallel paired flat surfaces which are also symmetrically paired with respect to the axis of the cylindrical body.

There are preferably 2, 4 or 6 crescent-shaped sections, which may or may not be identical, and their chords are in parallel pairs and also symmetrically paired with respect to the axis of the cylindrical body.

The inner wall of the shell and the crescents can be covered with a metallic coating, for example a Al–Zn coating produced using Schoop's metal spraying process.

DESCRIPTION OF THE PREFERRED EMBODIMENT

Figure 1:
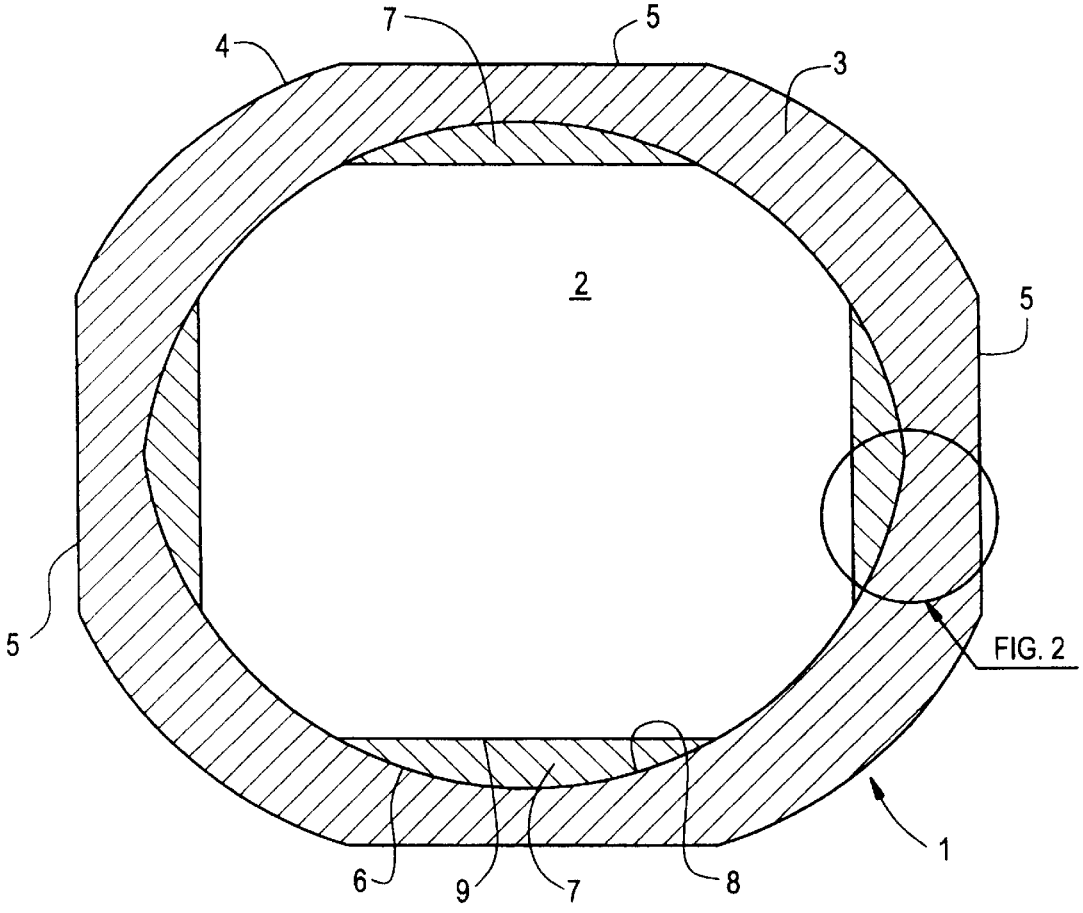
FIG. 1 shows a transverse section of a container of the invention.

In FIG. 1:

(1) denotes the cylindrical metal body of the container with a non-circular section;

(2) denotes the inner cavity of the container;

(3) denotes the initial thick shell, on the outer wall (4) of which flat surfaces (5) have been formed by grinding;

(6) denotes the inner wall of the shell onto which crescent-shaped sections (7) have been mounted whose cross-sectional perimeter essentially comprises an arc of a circle (8), with the same diameter as that of the inner cavity (2) bounded by the inner wall (6), the arc of the circle (8) being subtended by a chord (9) which thus represents a flat surface of the inner cavity (2).

It can therefore be seen that the cylindrical body of the container comprising the flat surfaces (5) and the crescents (7) subtended by their chords (9) which are parallel to the flat surfaces (5), clearly has a non-circular cross-section.

The dimensions of the flat surfaces and of the crescents can vary and can be adapted to the assemblies to be arranged in the cavity 2, always ensuring, however, that the thickness of the cylindrical body 1 satisfies shielding and mechanical strength standards.

Figure 2:
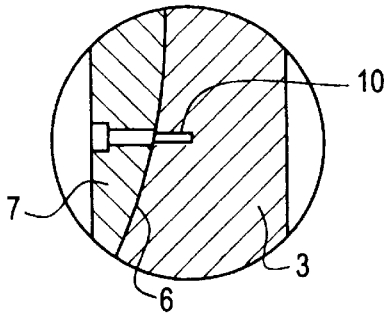
FIG. 2 shows a detail of a method for mounting a crescent-shaped section to the inner wall of the cylindrical body by means of a screw.

FIG. 2 denotes the body of the shell (3) and the crescent (7) mounted to the inner wall 6 of the shell by means of a screw (10).

Figure 3:
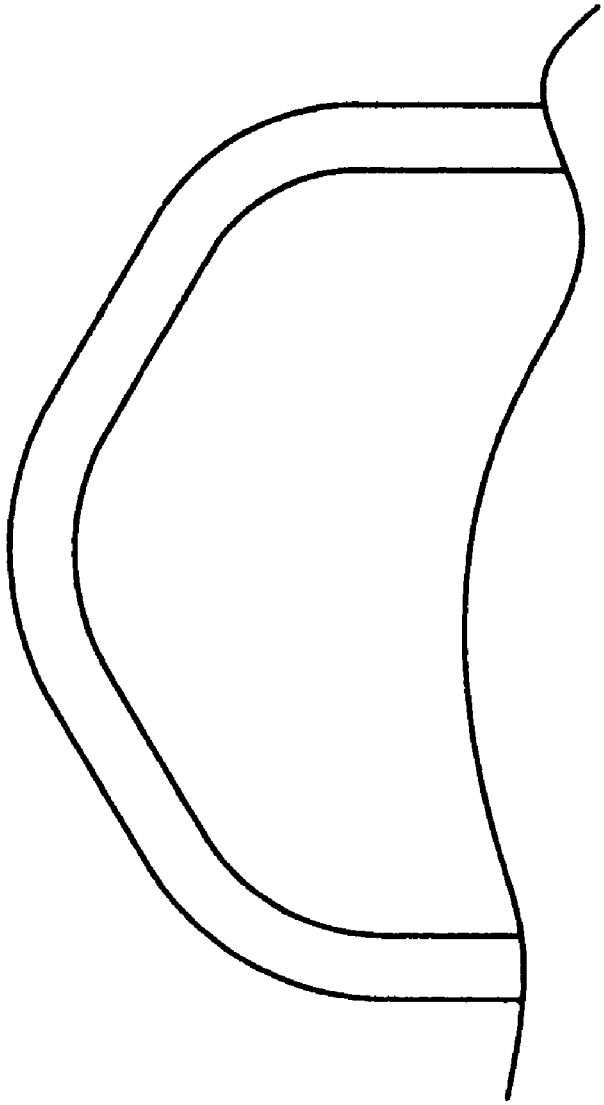
FIG. 3 shows a partial transverse section of a variation of the container of FIG. 1.

FIG. 3 shows a container similar to the container of FIG. 1, but in which the container is a hexagon with rounded corners.

What is claimed is:

1. A process for forming a container for nuclear fuel assemblies, comprising the steps of:

obtaining a thick shell of forged steel having a circular cross section and outer and inner walls;

lathe-turning the outer and inner walls coaxially to produce a cylindrical body having a circular cross section;

grinding the outer wall of the lathe-turned body to produce at least one flat surface on the outer wall along its entire height; and mounting at least one crescent shaped section having a cross section which comprises an arc of a circle with a radius identical to that of the inner wall subtended by a chord against the inner wall, said at least one flat surface being parallel to the chord.

2. A process according to claim 1, wherein said grinding produces an even number of flat surfaces disposed in pairs opposite to each other.

3. A process according to claim 2, wherein said grinding produces 2, 4 or 6 flat surfaces which are disposed symmetrically around the circular cross section, and wherein 2, 4 or 6 crescent-shaped sections are mounted against the inner wall, each crescent-shaped section having a chord mounted parallel to a flat surface.

4. A process according to claim 1, wherein the crescent shaped sections are mounted to the inner wall by screwing.

5. A process according to claim 1, additionally comprising spray coating the inner wall and crescent-shaped sections.

6. A process according to claim 5, wherein the spray coating comprises an Al–Zn deposit effected by a Schoop's metal spraying process.

* * * * *